US007297027B2

(12) United States Patent
Liang

(10) Patent No.: US 7,297,027 B2
(45) Date of Patent: Nov. 20, 2007

(54) ELECTRICAL CONNECTOR

(75) Inventor: Shih-Chieh Liang, Taoyuan (TW)

(73) Assignee: P-Two Industries Inc., Taoyuan (TW)

( * ) Notice: Subject to any disclaimer, the term of this patent is extended or adjusted under 35 U.S.C. 154(b) by 0 days.

(21) Appl. No.: 11/455,768

(22) Filed: Jun. 20, 2006

(65) Prior Publication Data

US 2007/0054552 A1 Mar. 8, 2007

(30) Foreign Application Priority Data

Sep. 5, 2005 (TW) ..... 94215342 U

(51) Int. Cl.
*H01R 13/648* (2006.01)

(52) U.S. Cl. ..... 439/608; 439/108

(58) Field of Classification Search ..... 439/608, 439/108

See application file for complete search history.

(56) References Cited

U.S. PATENT DOCUMENTS 6,386,924 B2 * 5/2002 Long ..... 439/701
6,619,985 B1 * 9/2003 Ko ..... 439/607
6,835,092 B2 * 12/2004 Wan et al. ..... 439/541.5
6,913,488 B2 * 7/2005 Motojima et al. ..... 439/607

* cited by examiner

*Primary Examiner*—Truc Nguyen
(74) *Attorney, Agent, or Firm*—Rosenberg, Klein & Lee

(57) ABSTRACT

An electrical connector has a rectangular insulative housing, a plurality of conductive terminals and a grounding plate respectively received in the housing, and a shell covering the housing. Cavities are defined at both sides of the housing and through a front surface and a rear surface thereof. The grounding plate includes a connecting portion, a plurality of contact pins extending from an edge of the connecting portion, and locking portions respectively extending from opposing sides of the connecting portion. In assembly, the grounding plate is inserted into the housing, the locking portions being embedded in the cavities. The shell has rear portions at a rear thereof for covering rear of the cavities thereby fixing the locking portions when assembled. At least a projecting point is formed on the connecting portion and opposite to the contact pins, and reliably contacts the rear portions of the shell for grounding.

7 Claims, 6 Drawing Sheets

A-A

B-B

ELECTRICAL CONNECTOR

BACKGROUND OF THE INVENTION

1. Field of the Invention

The present invention relates to an electrical connector, and particularly to an electrical connector adapted for a display interface for low voltage differential signal.

2. Related Art

An electrical connector for display panel, which is generally called Low Voltage Differential Signal (LVDS) connector, is soldered on a circuit board and electrically couples to a flexible bus. This connector has low profile, and accordingly, the way to configure a shell, terminals and grounding members thereof is constrained. Moreover, it should be under consideration that retention force of the electrical connector and connection strength between parts thereof. In general, the electrical connector has a metal shell covering a housing thereof for enhancing strength. Besides, the metal shell contacts a grounding member for eliminating electromagnetic wave or static electricity.

FIG. 1 is a simplified and partial view of a conventional electrical connector. The conventional electrical connector comprises a housing 1, terminals 2, a grounding plate 3 and a shell 4. A grounding spring 5 extends from a side of the grounding plate 3 and is exactly received in a recess 6 of the housing 1. The grounding spring 5 extends resiliently beyond a side of the housing 1, and in assembly, abuts against the shell 4 for electrically connecting the shell 4 and the grounding plate 3. However, the grounding spring 5 can not contact the shell 4 if upward resiliency of the grounding spring 5 is too small. Otherwise, if the grounding plate 3 is not fixed reliably, it may be ejected in the case that a mating connector (not shown) mates therewith repeatedly. An electrical connector to overcome above defects is desired.

SUMMARY OF THE INVENTION

Accordingly, an object of the present invention is to provide an electrical connector which has enhanced structure and lengthened lifespan.

Another object of the present invention is to provide an electrical connector which has a shell effectively contacting a grounding plate for guarding from electromagnetic interference.

The electrical connector of the present invention comprises a rectangular insulative housing, a plurality of conductive terminals received in the housing, a grounding plate, and a shell covering the housing. The housing has a front surface and a rear surface opposite to each other. A plug opening extends through the front surface, and cavities are defined at both sides of the housing and through the front surface and the rear surface. The grounding plate includes a connecting portion, a plurality of contact pins extending from an edge of the connecting portion, and locking portions respectively extending from opposing sides of the connecting portion. In assembly, the grounding plate is inserted into the housing, the contact pins extending into the housing, and the locking portions being embedded in the cavities. The shell has rear portions at both sides of a rear thereof for covering rear of the cavities when assembled. At least a projecting point is formed on the connecting portion and opposite to the contact pins and reliably contacts the rear portions of the shell for grounding.

DESCRIPTION OF THE PREFERRED EMBODIMENTS

Figure 1:
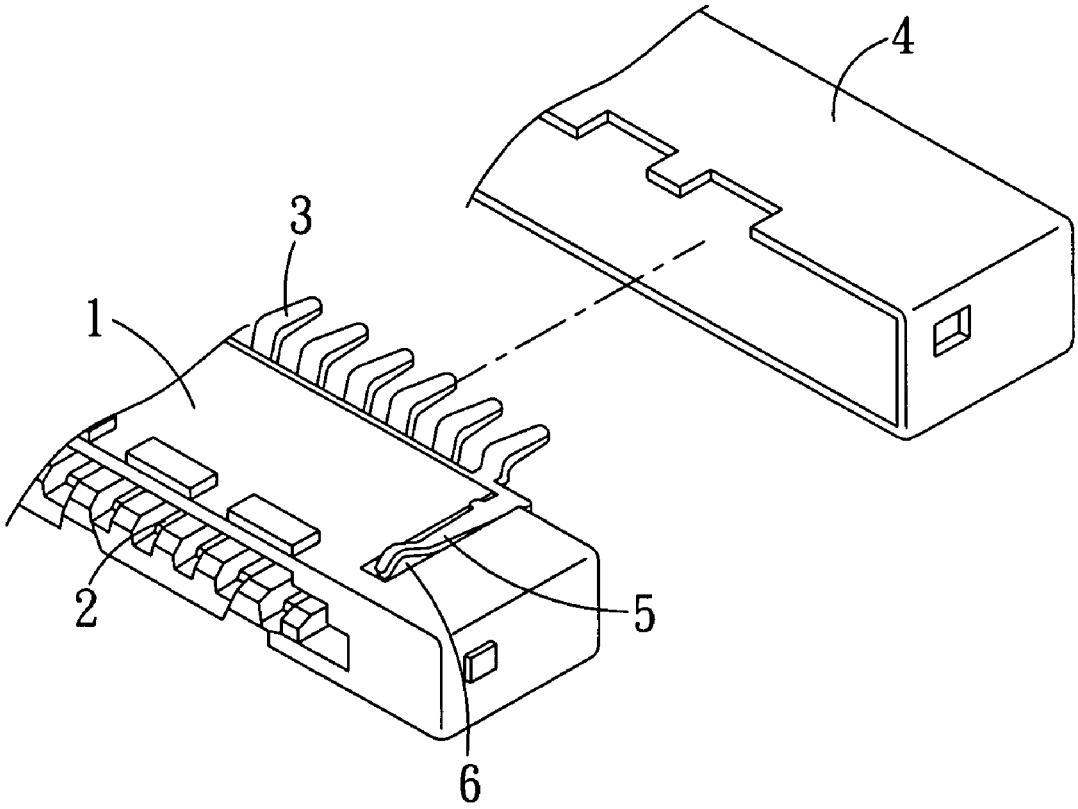
FIG. 1 is a simplified and partial view of a conventional electrical connector.
Figure 2:
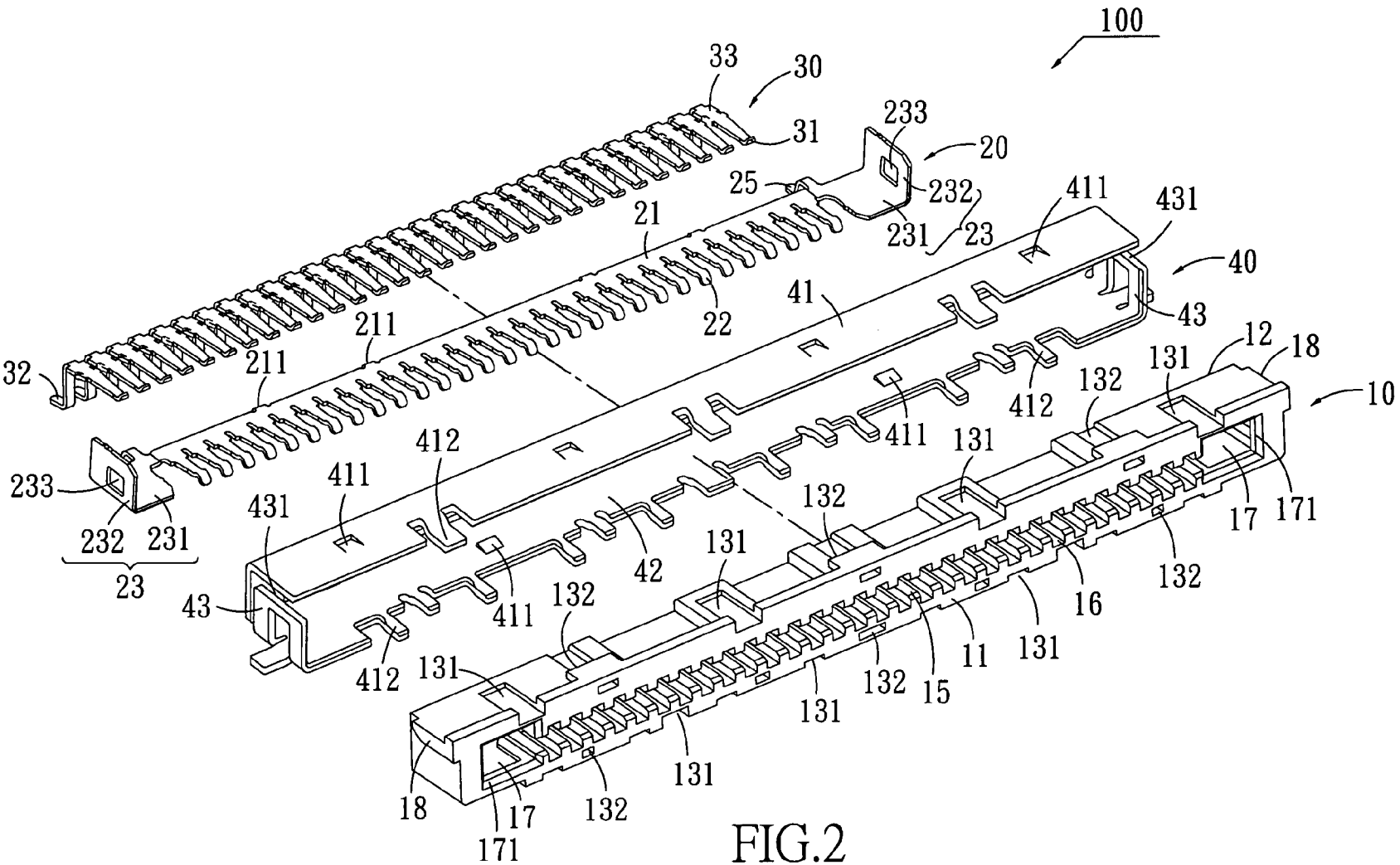
FIG. 2 is an exploded view of an electrical connector of the present invention.
Figure 3:
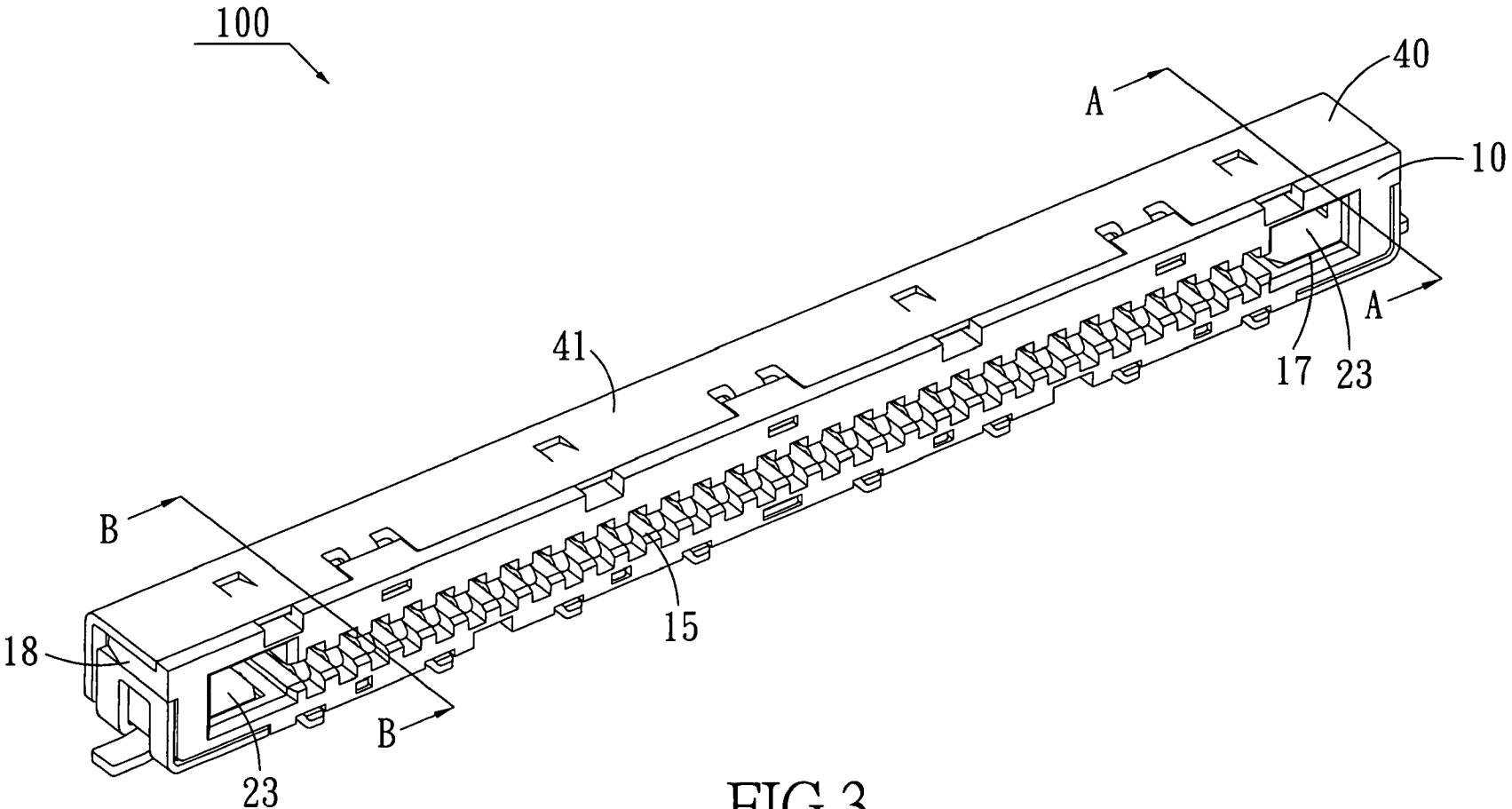
FIG. 3 is a perspective view of the electrical connector of FIG. 2.
Figure 4:
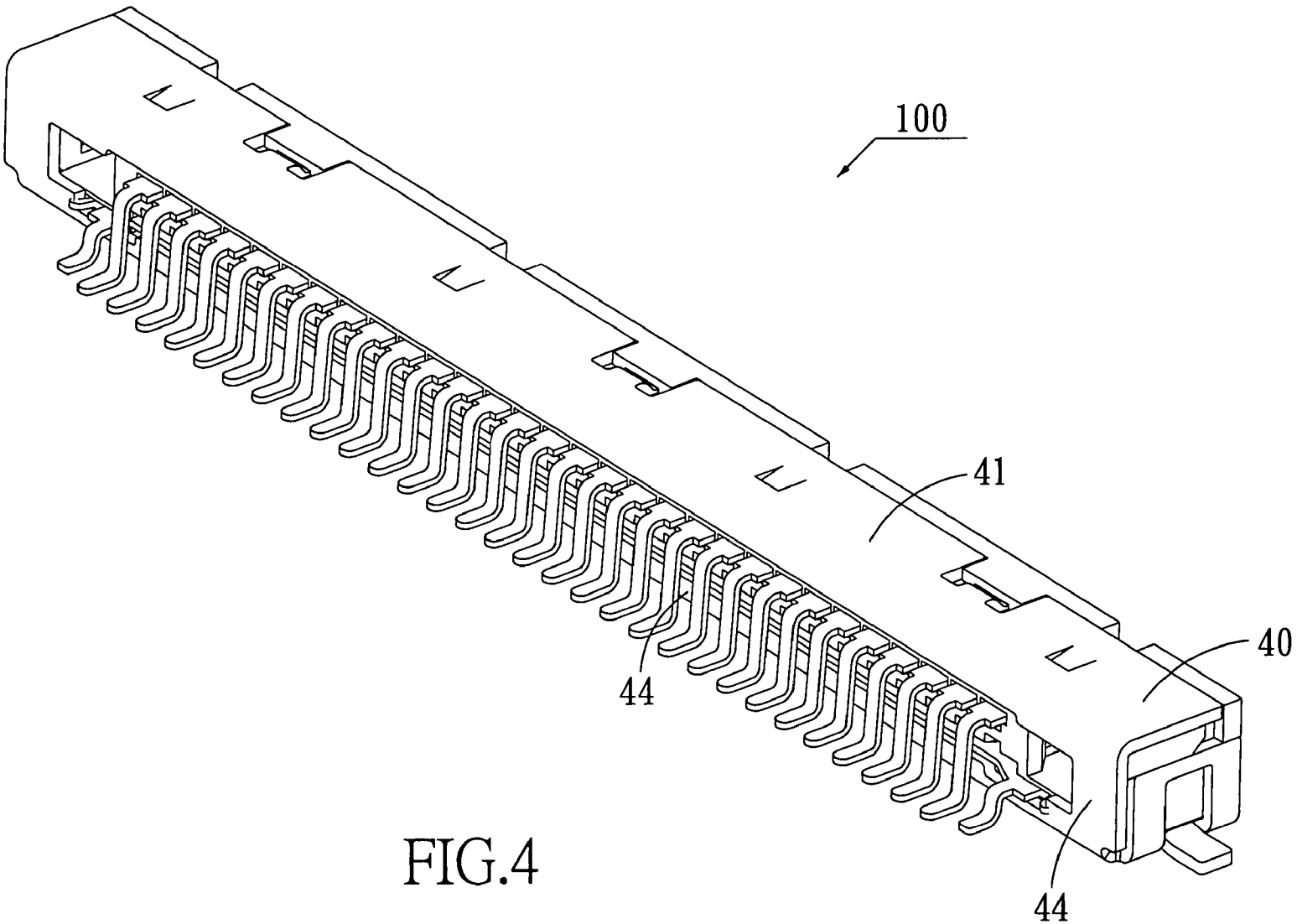
FIG. 4 is another perspective view of the electrical connector of FIG. 3 from another aspect.

With reference to FIGS. 2 through 4, an electrical connector 100 in accordance with the present invention comprises an insulative housing 10, a grounding plate 20, a plurality of conductive terminals 30 received in the insulative frame 10, and a shell 40 for shielding from electromagnetic interference. The housing 10 is elongated, rectangular and made of plastic, and has a front surface 11 and a rear surface 12 opposite to each other. A plug opening 15 is defined through the front surface 11 of the housing 10 for mating with a flexible bus (not shown). A plurality of plug grooves 16 is defined above/below the plug opening 15, respectively. Cavities 17 are defined at both sides of the housing 10 and through the front surface 11 and the rear surface 12. A plurality of recessed portions 131 and embedding grooves 132 are respectively formed on an upward surface (not labeled) and a downward surface (not labeled) of the housing 10. Sliding blocks 18 are respectively formed on opposite sides of the housing 10. The housing 10 further forms stop walls 171 along parts of front of the cavities 17 and adjacent both sides thereof for fixing the grounding plate 20.

The terminals 30 are assembled in the housing 10 individually. Each terminal 30 includes a contact end 31 at an end thereof, a soldering end 32 at an opposite end thereof, and a middle portion 33 between the contact end 31 and the soldering end 32. During assembly, the terminals 30 are inserted into the rear surface 12 of the housing 10. The contact ends 31 are received in the plug grooves 16 above the plug opening 15. The middle portions 33 are interferentially fixed in the housing 10. The soldering ends 32 extend out of the rear surface 12 of the housing 10 for electrically connecting with a circuit board (not shown).

Figure 5:
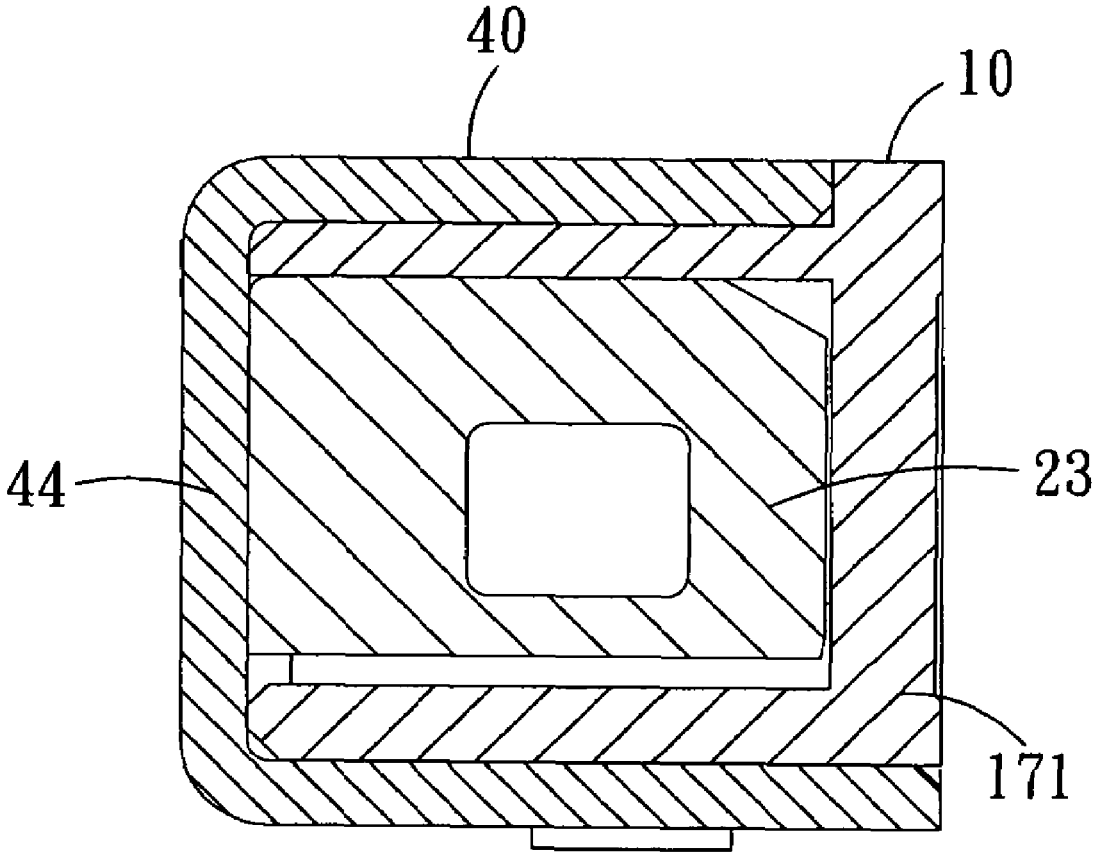
FIG. 5 is a cross-sectional view taken along the line A-A in FIG. 3.

The grounding plate 20 includes a connecting portion 21, a plurality of contact pins 22 extending perpendicularly from an edge of the connecting portion 21, and locking portions 23 respectively extending from opposing sides of the connecting portion 21. Each locking portion 23 includes a base 231 extending horizontally from a side of the connecting portion 21, and an extending portion 232 perpendicularly extending from the base 231. The extending portion 232 defines a slot 233 therein for latching a mating connector (not shown). During assembly, the grounding plate 20 is inserted from the rear surface 12 of the housing 10, and the contact pins 22 extend into the plug grooves 16 below the plug opening 15. The contact pins 22 and the contact ends 31 of the terminals 30 correspond to each other, and cooperate to sandwich a flexible bus therebetween when the flexible bus (not shown) is inserted into the plug opening 15. Meanwhile the locking portions 23 of the grounding plate 20 are embedded into the cavities 17 of the housing 10. The bases 231 and the extending portions 232 of the locking portions 23 bias against inner walls of the cavities 17, and are positioned by the stop walls 171 of the housing 10, as shown in FIG. 5. Soldering portions 25 extend from edges of the connecting portion 21 and opposite the contact pins 22.

During assembly, the grounding plate 20 and the terminals 30 are assembled onto the housing 10, thereafter the shell 40 is brought to cover the housing 10 from the rear surface 12 thereof. The shell 40 is made of metal and is shaped according to profile of the housing 10. The shell 40 has an upper wall 41 and a lower wall 42 opposite to each other, and a pair of lateral walls 43 on both sides thereof. A plurality of spring sheets 411 and fixing sheets 412 extend from the upper wall 41 and the lower wall 42. Each lateral wall 43 defines a slit 431 therein. When the shell 40 envelops the housing 10, the spring sheets 411 abut against the recessed portions 131, and the fixed sheets 412 are embedded into the embedding grooves 132, whereby the shell 40 is positioned. At the same time, the sliding blocks 18 are respectively retained in the slits 431 of the shell 40 for improving retention.

Referring to FIGS. 4 and 5, the shell 40 has rear portions 44 at both sides of a rear thereof for covering rear of the cavities 17 when assembled. In assembly, the rear portions 44 abut the connecting portion 21 and the locking portions 23, preventing the grounding plate 20 from ejecting backward owing to front external force. Moreover, the rear portions 44 cooperate with the stop walls 171 to fix the locking portions 23 inside the cavities 17. In the event that a flexible bus (not labeled) is inserted, opposite sides of the flexible bus interferentially engage with the slots 233 of the locking portions 23. Hence, no matter how the flexible bus plugs repeatedly, the locking portions 23 will not deflect, correspondingly lengthening the life of the electrical connector 100. The soldering portions 25 of the grounding plate 20 and the soldering ends 32 of the terminals 30 extend outward from between the rear portions 44.

Figure 6:
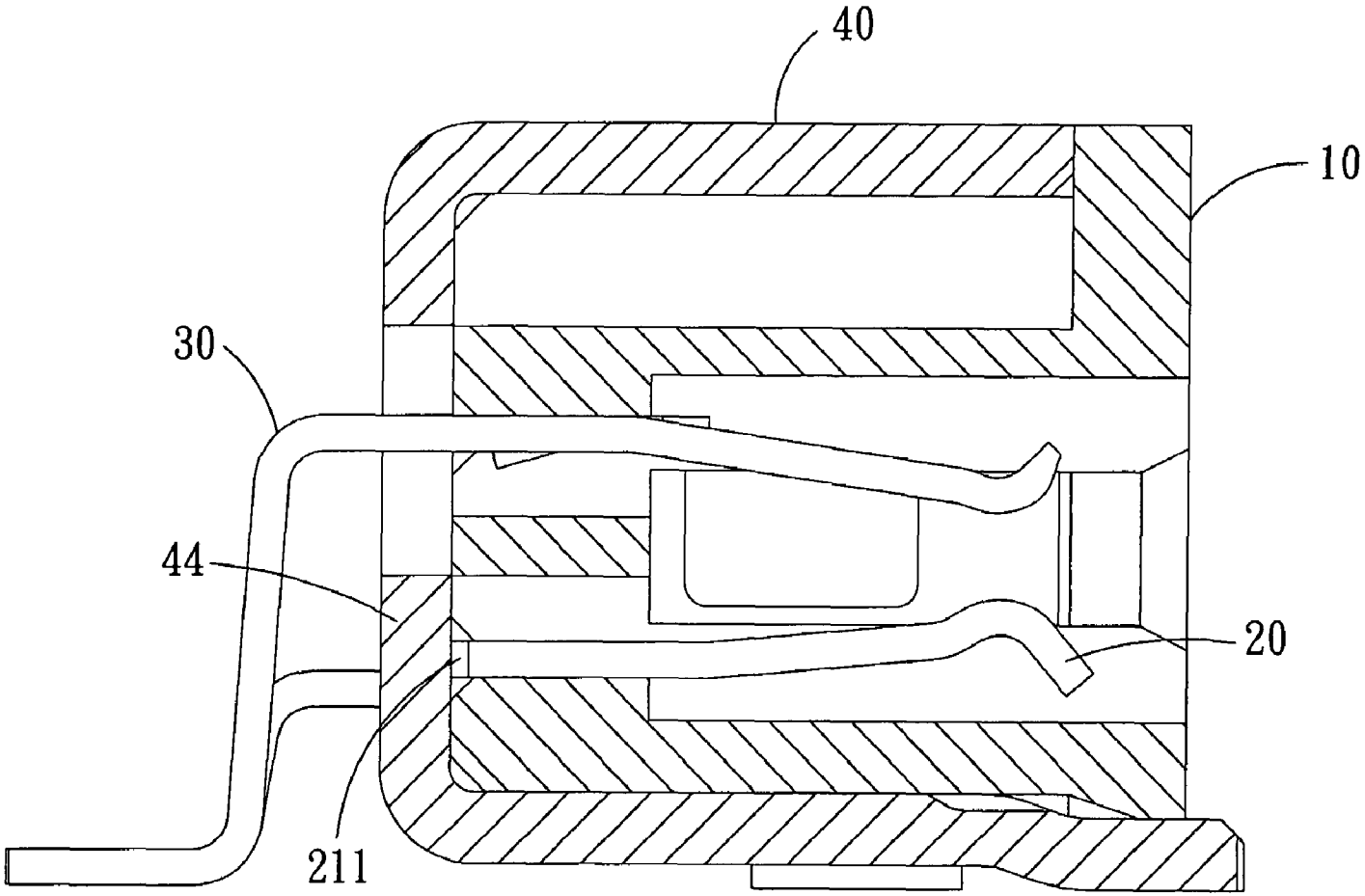
FIG. 6 is a cross-sectional view taken along the line B-B in FIG. 3.

Referring to FIGS. 2 and 6, at least a projecting points 211 is formed on the connecting portion 21 of the grounding plate 20 and opposite to the contact pins 22, so as to form reliable contact between the grounding plate 20 and the shell 40. In assembly, the rear portions 44 of the shell 40 reliably contact the projecting points 211 for making the shell 40 grounded. In another embodiment, the projecting points 211 are formed on sides of the locking portions 23 of the grounding plate 20 for making the shell 40 grounded.

The locking portions 23 of the grounding plate 20 are held in the cavities 17 of the housing 10, and are further fixed by the rear portions 44 of the shell 40. The projecting points 211 of the grounding plate 20 further makes the grounding plate 20 reliably contact the shell 40, simplifying manufacture and further ensuring interconnection between parts of the electrical connector 100.

It is understood that the invention may be embodied in other forms without departing from the spirit thereof. Thus, the present examples and embodiments are to be considered in all respects as illustrative and not restrictive, and the invention is not to be limited to the details given herein.

The invention claimed is:

1. An electrical connector comprising:

a rectangular insulative housing having a front surface and a rear surface opposite to each other, a plug opening extending through the front surface, cavities being defined at both sides of the housing and through the front surface and the rear surface;

a plurality of conductive terminals received in the housing;

a grounding plate including a connecting portion, a plurality of contact pins extending from an edge of the connecting portion, and locking portions respectively extending from opposing sides of the connecting portion, in assembly, the grounding plate being inserted into the housing, the contact pins extending into the housing, and the locking portions being embedded in the cavities; and a shell covering the housing, and having rear portions at both sides of a rear thereof for covering rear of the cavities when assembled;

wherein each locking portion includes a base and an extending portion perpendicularly extending from the base, the extending portion defining a slot therein for latching a mating connector.

2. The electrical connector as claimed in claim 1, wherein the housing further forms stop walls along parts of front of the cavities for fixing the grounding plate.

3. The electrical connector as claimed in claim 1, wherein a plurality of recessed portions is respectively formed on an upward surface and a downward surface of the housing, and wherein the shell forms a plurality of spring sheets for abutting against the recessed portions.

4. The electrical connector as claimed in claim 1, wherein the a plurality of embedding grooves is formed on an upward surface and a downward surface of the housing, and wherein the shell forms a plurality of fixing sheets for being embedded into the embedding grooves.

5. The electrical connector as claimed in claim 1, wherein sliding blocks are respectively formed on opposite sides of the housing, and wherein the shell defines slits at both sides thereof, the sliding blocks being retained in the slits.

6. An electrical connector comprising:

a rectangular insulative housing having a plug opening extending through a front surface thereof;

a plurality of conductive terminals received in the housing;

a grounding plate mounted on the housing, and including a connecting portion, a plurality of contact pins, extending from an edge of the connecting portion, at least a projecting point being formed on the connecting portion and opposite to the contact pins the grounding plate including a locking portion having a base and an extending portion perpendicularly extending from the base, the extending portion defining a slot therein for latching a mating connector; and a shell covering the housing, and having rear portions at a rear thereof for contacting the projecting points in assembly.

7. The electrical connector as claimed in claim 6, wherein locking portions respectively extend from opposing sides of the connecting portion, and form projecting points on sides thereof for contacting rear portions of the shell.

* * * * *